US012371913B1

(12) United States Patent
Goeken et al.

(10) Patent No.: US 12,371,913 B1
(45) Date of Patent: Jul. 29, 2025

(54) MOVEABLE EDGE SCAFFOLD

(71) Applicants: Joe Goeken, Ukiah, CA (US); Alex Goeken, Ukiah, CA (US)

(72) Inventors: Joe Goeken, Ukiah, CA (US); Alex Goeken, Ukiah, CA (US)

( * ) Notice: Subject to any disclaimer, the term of this patent is extended or adjusted under 35 U.S.C. 154(b) by 0 days.

(21) Appl. No.: 18/615,414

(22) Filed: Mar. 25, 2024

(51) Int. Cl.

| | |
|---|---|
| ***E04G 5/00*** | (2006.01) |
| ***E04G 3/20*** | (2006.01) |
| ***E04G 5/04*** | (2006.01) |
| ***E04G 5/10*** | (2006.01) |
| ***E04H 4/14*** | (2006.01) |

(52) U.S. Cl.
CPC ..... *E04G 5/006* (2013.01); *E04G 3/20* (2013.01); *E04G 5/04* (2013.01); *E04G 5/10* (2013.01); *E04H 4/14* (2013.01)

(58) Field of Classification Search
CPC .. E04G 5/006; E04G 3/20; E04G 5/04; E04G 5/10; E04H 4/14
See application file for complete search history.

(56) References Cited

U.S. PATENT DOCUMENTS

| | | | | |
|---|---|---|---|---|
| 5,492,197 | A * | 2/1996 | Yonahara | E04G 3/20 182/83 |
| 2005/0199441 | A1* | 9/2005 | Thery | E04G 3/20 182/82 |
| 2006/0163001 | A1* | 7/2006 | Pozell | E04G 5/048 182/82 |

* cited by examiner

*Primary Examiner* — Rodney Mintz
(74) *Attorney, Agent, or Firm* — Cynthia S. Lamon; Lamon Patent Services

(57) ABSTRACT

A scaffold apparatus has an upper horizontal structure of a first width, a vertical structure having a first and a second vertical member attached each at opposite ends of the first width of the upper horizontal structure, and a platform structure attached at a lowermost point to the vertical structure, extending away from the vertical structure in a direction opposite direction of the upper horizontal structure, such that the scaffold apparatus, viewed in side elevation, forms an L-shape. The upper horizontal structure lies flat on a surface at an upper edge of a walled space and extends the vertical structure downward into the walled space proximate a wall of the walled space, and the platform structure extends from a lower end of the vertical structure into the walled space, providing a support surface for a user to stand upon to perform maintenance on the wall proximate the vertical structure.

13 Claims, 7 Drawing Sheets

MOVEABLE EDGE SCAFFOLD

BACKGROUND OF THE INVENTION

1. Field of the Invention

The present invention is in the technical field of apparatus for aiding access for contractors in repair projects and pertains more particularly to a static moveable edge scaffold.

2. Description of Related Art

Apparatus is known to hang down into a walled space to provide access to contractors for repair and maintenance of the material and structure of the walls. The known apparatus is typically suspended from a pulley system and is difficult to move and relocate. Further, using a ladder from a floor of the walled space is also not workable, because these spaces are typically rounded at the bottom in pools and tanks, making the ladders unsteady.

What is clearly needed is an apparatus that enables a contractor to place the apparatus, secure the apparatus in place, use the apparatus to access the surfaces as needed, and that is easy to relocate to access other surfaces.

BRIEF SUMMARY OF THE INVENTION

A scaffold apparatus is provided in one embodiment, comprising an upper horizontal structure of a first width, a vertical structure having a first and a second vertical member attached each at opposite ends of the first width of the upper horizontal structure. A platform structure may be attached at a lowermost point to the vertical structure, extending away from the vertical structure in a direction opposite a direction of the upper horizontal structure, such that the scaffold apparatus, viewed in side elevation, forms an L-shape. In this embodiment the upper horizontal structure may be lying flat on a surface at an upper edge of a walled space which extends the vertical structure downward into the walled space proximate a wall of the walled space, and the platform structure extends from a lower end of the vertical structure into the walled space, providing a support surface for a user to stand upon to perform maintenance on the wall proximate the vertical structure.

In one embodiment the upper horizontal structure, the vertical structure and the platform structure each comprise welded assemblies of lengths of hollow square or circular metal tubing. The upper horizontal structure may also include a first and a second separate hollow square or circular metal tubing each attached to one of the vertical members of the vertical structure.

In another embodiment the upper horizontal structure is a rectangular welded assembly of hollow square or circular metal tubing having one longer lengthwise member and two shorter side members and the two vertical members of the vertical structure may attach to ends of the two shorter side members away from the one longer lengthwise member.

In this or another embodiment the upper horizontal structure is a rectangular welded assembly of hollow square metal tubing having two longer lengthwise members and two shorter side members and the two vertical members of the vertical structure attach to ends of the two shorter side members.

In another embodiment the platform structure comprises a rectangular welded assembly of hollow square or circular metal tubing covered by an expanded metal sheet. In this embodiment, an attachment interface enables the upper horizontal structure to be anchored in place to the surface at the edge of the walled space. Additionally, the attachment interface involves placing one or more stakes next to or through one or more of the lengths of hollow square metal tubing of the upper horizontal structure.

One embodiment provides a ladder comprising a third vertical member in the vertical structure joined at vertical intervals by a plurality of horizontal members as ladder rungs between the third vertical member and either the first or the second vertical members. In this embodiment, the first, the second and the third vertical members lie in a plane parallel the wall of the walled space, such that the ladder is in the plane of the vertical structure. Additionally, the third vertical member is attached to a side member of the platform structure, such that the ladder is in a plane at a right angle to the vertical structure.

In yet another embodiment, the vertical structure comprises the first and second vertical members as hollow square or round metal tubing having a first square dimension, each having a plurality of horizontal through holes spaced apart along a height of the first and second vertical members. Additionally third and fourth vertical members as hollow square or circular metal tubing having a second square dimension greater than the first square dimension, the first and second vertical members sliding into the third and fourth vertical members is provided, with the platform structure welded to a lower extremity of the third and fourth vertical members. In this embodiment, a first and a second pin structure on each of the third and fourth vertical members may be adapted such that a first pin of the first pin structure may pass through an individual one of the plurality of through holes spaced apart along the height of the first vertical member, and a second pin of the second pin structure may pass through an individual one of the plurality of through holes spaced apart along the height of the second vertical member, thereby fixing vertical position of the platform structure relative to the upper horizontal structure. The first and second pins may be withdrawn and reinserted into a different one of the plurality of through holes on the first and second vertical members, changing the vertical position of the platform structure relative to the upper horizontal structure.

DETAILED DESCRIPTION OF THE INVENTION

Figure 1A:
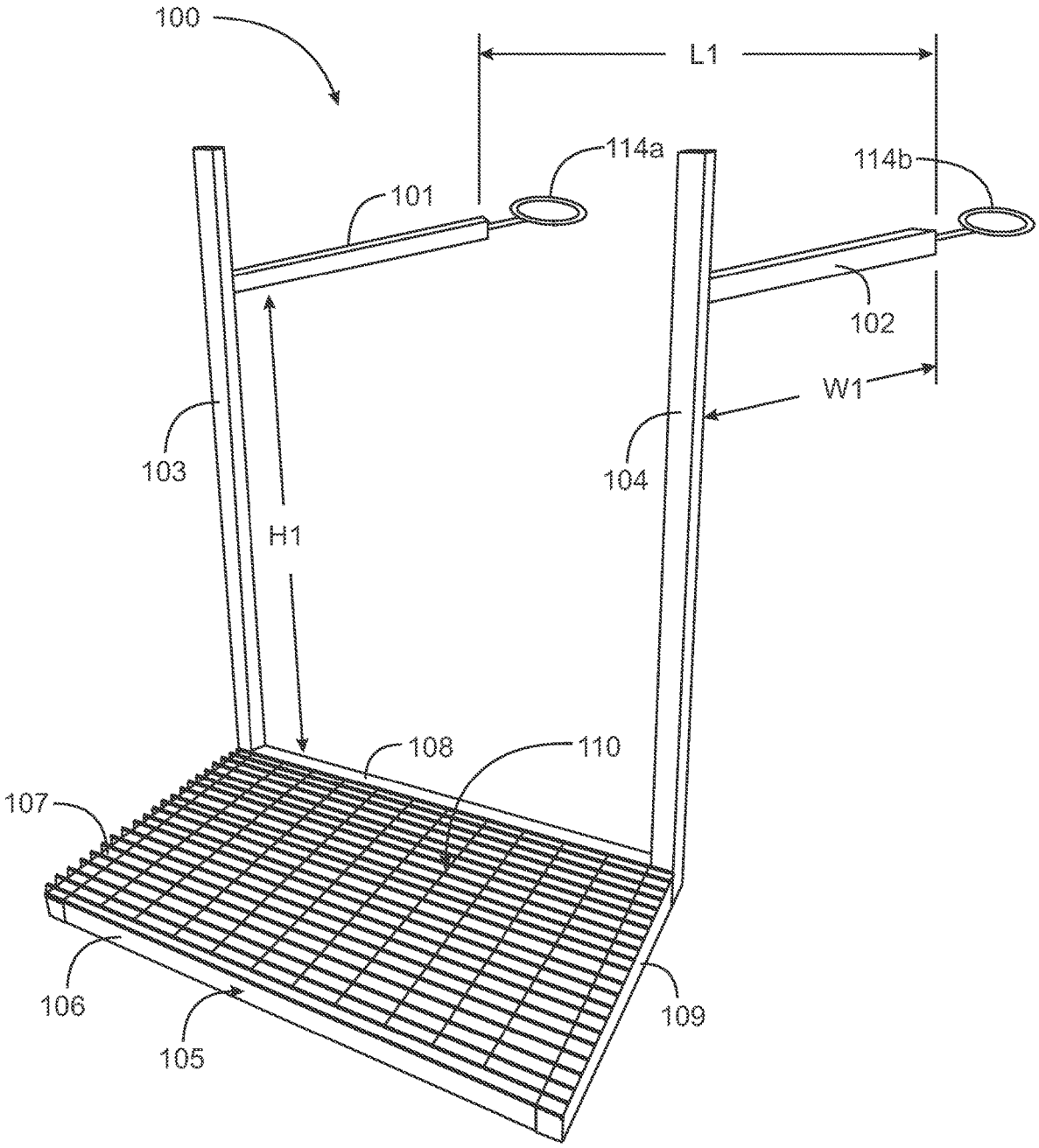
FIG. 1A is a perspective view of an apparatus in one embodiment of the invention.

FIG. 1A is a perspective view of an apparatus 100 in one embodiment of the invention. Apparatus 100 has two vertical bars 103 and 104 with a horizontal bar 101 joined to and extending away from vertical bar 103, and a horizontal bar 102 joined to and extending away from vertical bar 104. Horizontal bars 101 and 102 define a length L1, between the two bars, which may vary in different embodiments. Apparatus 100 is adapted to extend bars 101 and 102 over a surface near an edge of a walled space with vertical bars 103 and 104 extending down into the walled space a height H1 proximate a wall of the walled space. Height H1 may vary in different embodiments. In one embodiment H1 is between 2-5 feet, while W1 may be half of H1. In this manner arms 101 and 102 make significant contact with ground preventing the scaffold from tipping backwards away from a wall it is mounted on.

A rectangular structure 105, comprising bars 106, 107, 108 and 109 is joined to bars 103 and 104 at a lower extremity, and is covered with an expanded metal support platform 110 providing a support where a contractor may stand to do service and maintenance work on an adjacent wall. Attachment rings 111*a* and 111*b* are attached at ends of bars 101 and 102 at the ends away from vertical bars 103 and 104, and provide anchor points where the apparatus may be constrained by such as rope or cable to a vehicle or other stable structure.

Figure 1B:
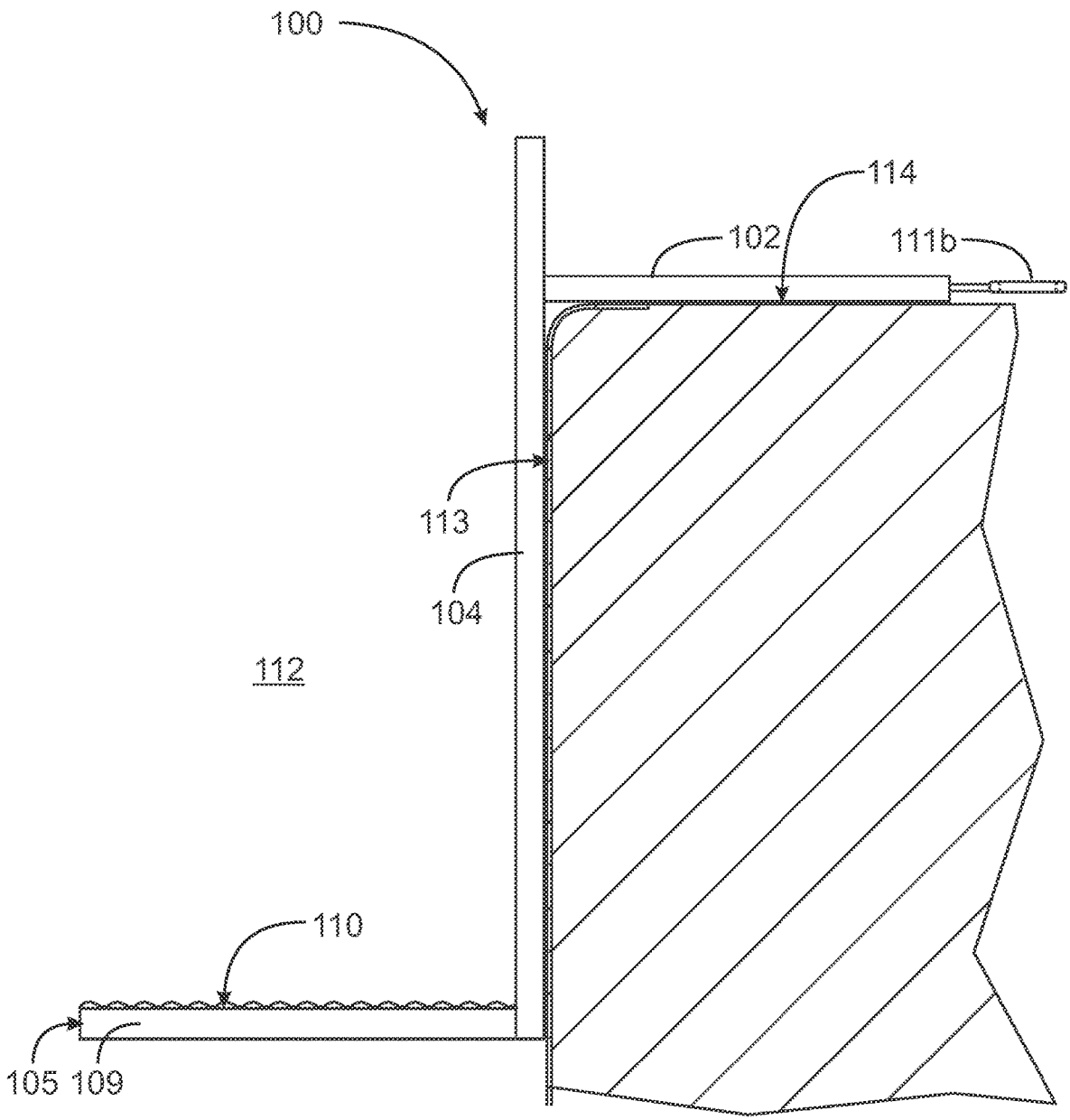
FIG. 1B is a side elevation view of the apparatus of FIG. 1 deployed at an edge of a walled space in an embodiment of the invention.

FIG. 1B is a side elevation view of apparatus 100 of FIG. 1A deployed into a walled space 112 having a vertical wall 113 and a horizontal surface 114 extending from an upper edge of the walled space, which may be such as a swimming pool. Apparatus 100 is deployed into space 112 as shown with the bars 101 (not shown) and 102 lying on surface 114, and vertical bars 103 (not seen) and 104 against wall 113 of the walled space. Structure 105 of the platform is supported be segment bars 107 and 109 and extends into walled space 112, attached to vertical bars 103 and 104. In the embodiment where wall 113 is an inside wall of a swimming pool, the lower portion of the scaffold including platform 110 and vertical bars including 104 may be submerged in water. The length of arms 102 and 103 serve to hold the scaffold in place without shifting.

Figure 2:
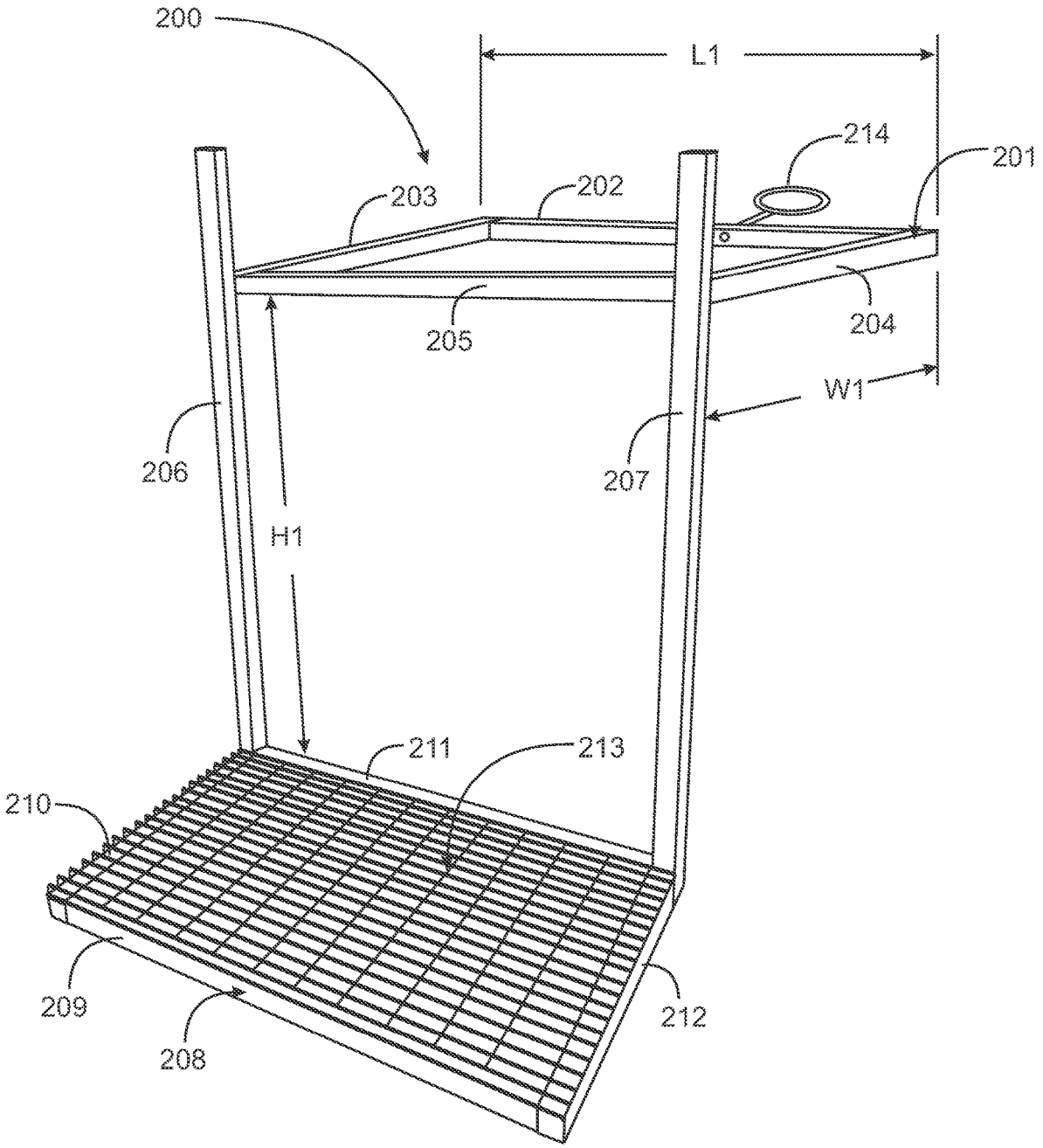
FIG. 2 is a perspective view of an apparatus in an alternative embodiment of the invention.

FIG. 2 is a perspective view of a scaffold in an embodiment of the invention. Apparatus 200 has an upper rectangular, horizontal frame portion 101 that comprises four straight bars 202, 203, 204 and 205, and has a length L1 and a width W1. In this example the four bars are hollow, square aluminum or steel tubing, but the nature of tubing is not a limitation. Frame portion 201 in this embodiment is welded to a vertical frame portion of a height H1 comprising a first bar 206 and a second bar 207, which in this example are also hollow, square aluminum or steel tubing. At a lowermost extremity of bars 206 and 207 a lower, rectangular horizontal frame portion 208, comprising four bars 209, 210, 211 and 212, also in this example hollow square aluminum or steel tubing, is welded to bars 206 and 207. Frame portion 208 is covered by expended metal sheet 213. The expanded metal sheet may be either aluminum or steel.

In an embodiment of the invention the welded assembly of upper frame portion 201, vertical bars 206 and 207, and lower frame portion 208 covered with expanded metal sheet provides a moveable edge scaffold 200 wherein upper frame portion 201 may overlie a surface at an edge of a walled space, such as, for example, a swimming pool, with vertical members 206 and 207 extending downward along a tiled wall of the walled space and supporting frame member 208 with expanded metal cover 213, as a platform upon which a contractor may stand to inspect, repair and maintain the wall proximal to the welded assembly. The rectangular nature of upper frame portion 201 in this variation has an advantage of rigidity, but will be somewhat heavier.

Apparatus 200 may be fixed in position along an edge of the walled space by stakes inside, or over bar 202, for example. There may be one or more vertical holes through member 102 through which a stake may be driven. Alternatively, an attachment interface 214 may be joined and centered on bar 202 to anchor the apparatus to a vehicle or other stable point instead of implementing attachment rings 111*a* and 11*b* as shown in FIGS. 1*a* and 1B.

Figure 3:
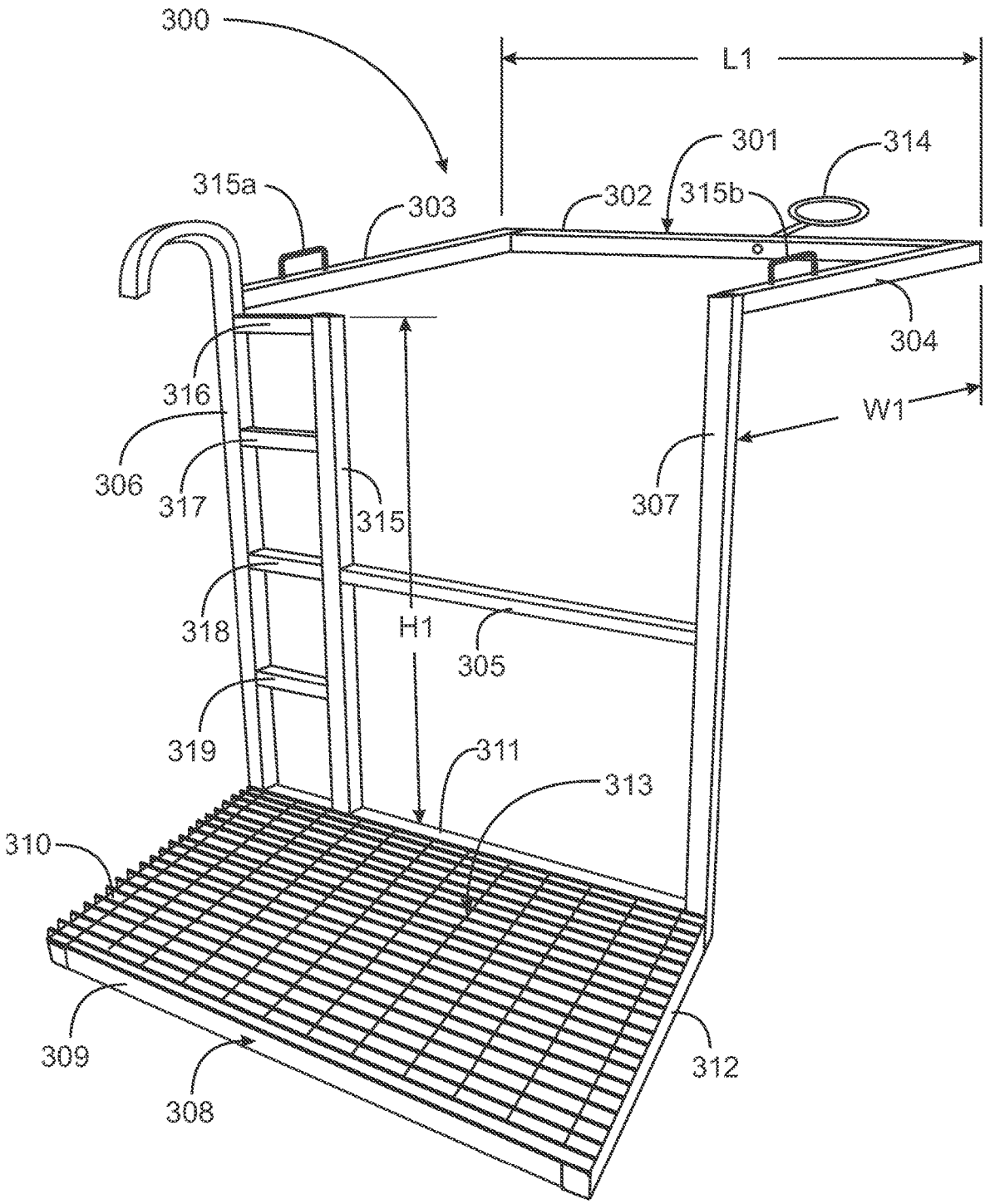
FIG. 3 is a perspective view of an apparatus in another alternative embodiment of the invention.

FIG. 3 is a perspective view of an apparatus 300 in an alternative embodiment of the invention. The apparatus of FIG. 3 differs from that of FIG. 2 in that a ladder is incorporated in the apparatus of FIG. 3 by vertical bar 315 and four horizontal bars 316, 317, 318 and 319, welded horizontally between bar 315 and bar 306, providing rungs of the ladder. The ladder is also reinforced at a center point of 315 by horizontal bar 305 fastened between vertical bar 315 and vertical bar 307. The ladder facilitates a contractor moving from the upper level outside the walled space down to the platform 313. A skilled person will understand that there may be different ways to form the structures and the ladder equivalent to the structure illustrated in FIG. 2. Parts of the apparatus of FIG. 3 that are analogous to parts of FIG. 2 are renumbered to correspond to FIG. 3.

It will be understood by the skilled person that the apparatus of FIG. 3 may be anchored and moved in the same ways described for the apparatus of FIG. 1 and that of FIG. 2.

Figure 4:
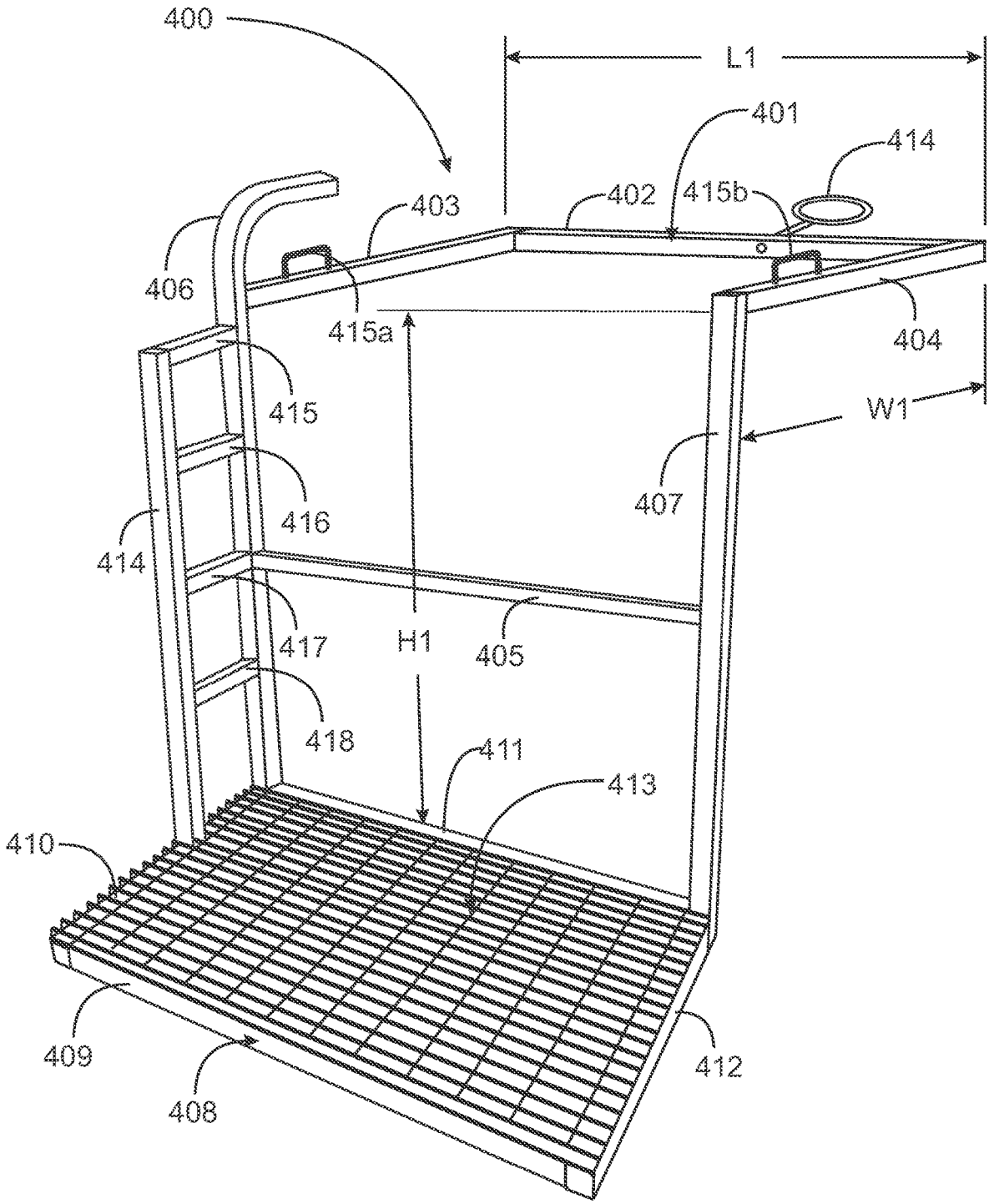
FIG. 4 is a perspective view of an apparatus in yet another alternative embodiment of the invention.

FIG. 4 is a perspective view of an apparatus 400 in another alternative embodiment of the invention. Parts of the apparatus of FIG. 4 that are analogous to parts apparatus 200 and 300 are renumbered to correspond to FIG. 4 The apparatus of FIG. 4 differs from that of FIG. 2 in that a ladder is incorporated in the apparatus of FIG. 4 by vertical bar 414 and four horizontal bars 415, 416, 417 and 418, welded horizontally between bar 414 and bar 406, providing rungs of the ladder, and the ladder is oriented in an aspect 90 degrees from that of FIG. 3. The ladder facilitates a contractor moving from the upper level outside the walled space down to the platform provided by frame portion 408, and in the orientation shown does not occlude any of the face of the wall proximate the apparatus. A skilled person will understand that there may be different ways to form the structures and the ladder equivalent to the structure illustrated in FIG. 4.

It will be understood by the skilled person that apparatus 400 of FIG. 4 may be anchored and moved in the same ways described for apparatus 100, 200 and 300.

Figure 5:
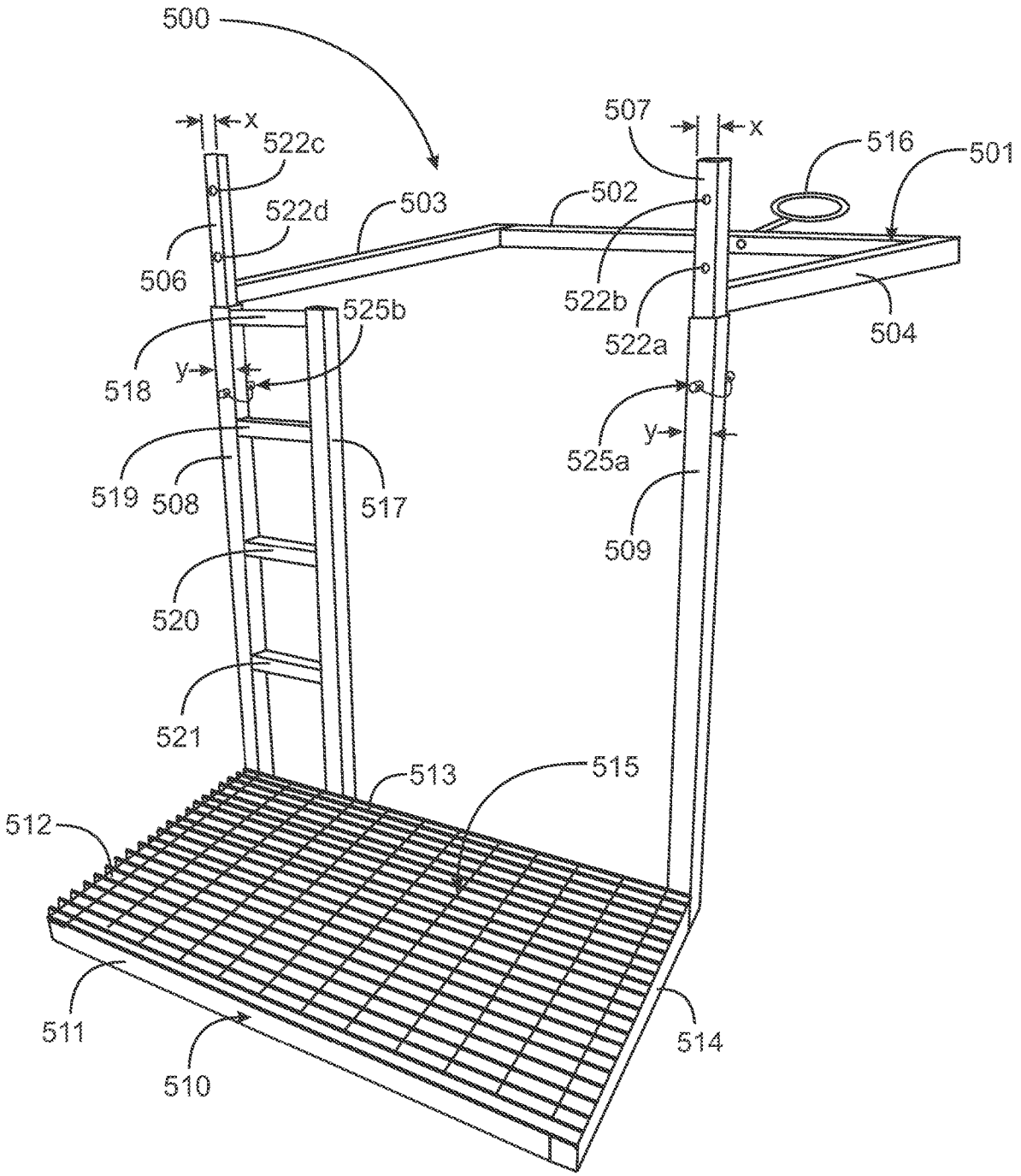
FIG. 5 is a perspective view of an apparatus in yet another alternative embodiment of the invention.

FIG. 5 is a perspective view of an apparatus 500 quite similar to the apparatus 300 of FIG. 3, with provision made to enable a user to raise and lower the support platform, in this example formed by frame portion 510, covered by expanded metal 515, upon which a contractor stands in working on the adjacent wall.

In the apparatus 500 the upper frame portion 501, comprising bars 502, 503, and 504, is not joined rigidly to vertical bars 508 and 509, but instead to additional vertical bars 506 and 507, which in this example are hollow square metal tubing of nominal dimension "x". Vertical bars 306 and 307 of apparatus 300 in FIG. 3 are in FIG. 5 replaced by vertical bars 508 and 509, which are hollow metal square tubing of nominal dimension "y". Tubing 506 is a slip fit into tubing 508 and tubing 507 is a slip fit into tubing 509, such that the lower frame structure supported by vertical tubing 508 and 509 may be raised and lowered relative to the upper frame structure formed by frame portion 501 and vertical bars 506 and 507.

Vertical bars 506 and 507 in this example have through holes 522*a*, 522*b*, 522*c* and 522*d* shown, and additional holes down the length of bars 506 and 507. There are pin mechanisms 525*a* and 525*b* through holes in vertical bars 508 and 509, adapted such that the pins may be withdrawn to adjust the height of the platform formed by structure 510, and replaced to secure the assembly at a new height. In practice the height adjustments may be made with the assembly withdrawn from the walled structure. Attachment interface 516 joined to upper frame structure 501 serves to anchor the apparatus in use, as described previously for other apparatus.

In some embodiments a "lighter" version of scaffold 100 is used when the platform and lower portion is positioned underwater, for example extending into a swimming pool. In this embodiment, a lighter gage metal, such as aluminum, having a smaller dimension of tubing may be used to manufacture scaffold 500 as a weight of a contractor would be diminished by buoyancy of the water.

The skilled person will understand that the height adjustable features illustrated in FIG. 5 and described with reference to FIG. 5 may be applied to the various apparatus illustrated in FIG. 1, FIG. 2, FIG. 3 and FIG. 4 as well.

Figure 6:
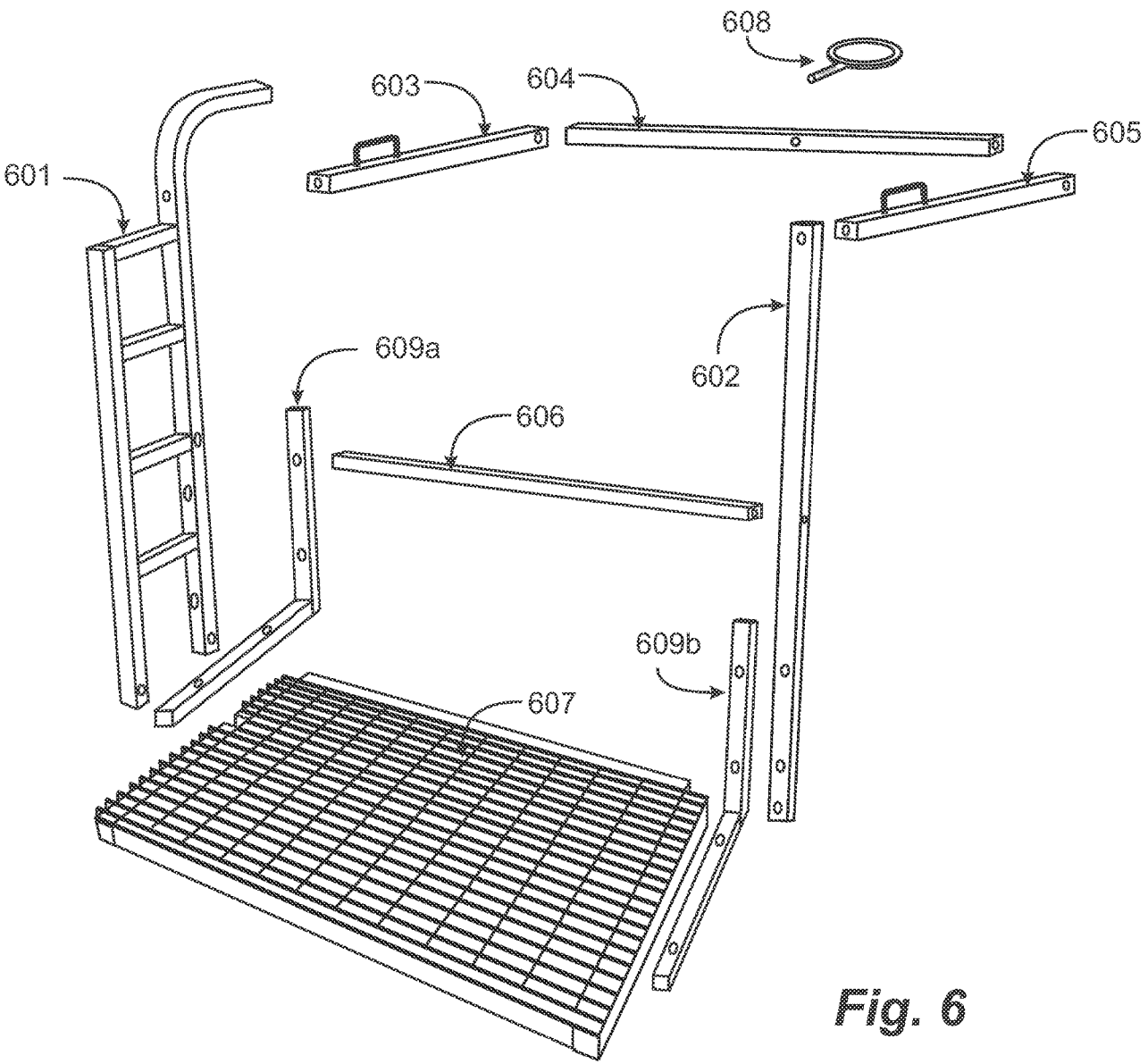
FIG. 6 is a disassembled view of an apparatus in one embodiment of the invention.

FIG. 6 demonstrates a disassembled view where individual parts may be inserted into a box or bag enabled to be shipped and assembled by an end user. In this embodiment "L" shaped bars 609*a* and 609*b* would serve to support platform 607. A small cutout 610 on an edge of platform 607 serves to secure leg 611 when assembled. Handles 615*a* and 615*b* are fixed to arm 603 and 605, respectively. The handles make it easier for a contractor to lift and drop the assembled scaffold against a wall during use and a top portion of vertical bar 612 is bent at a 90 degree angle to aid in stepping up and down the ladder as well as aiding in lowering and lifting the scaffold.

The skilled person will understand that the apparatus illustrated and described above is entirely exemplary, and not limiting to the scope of the invention. For example, many different sorts of bars and other members may be used in construction of frame members of the apparatus, and of different dimensions. The apparatus itself may be made in widely variable dimensions to serve walled structures of different depths and dimensions. There are many features that may be varied within the scope of the invention, which is limited only by the claims that follow.

The invention claimed is:

1. A scaffold apparatus, comprising:

a vertical structure having a first and a second tubular elongate vertical member, each tubular elongate member having a front side, an opposing back side, an inner side and an outer side, a top end and a bottom end;

an upper horizontal structure having a first and a second horizontal elongate member each having a length, each of the first and second horizontal elongate members attached at opposing ends of the vertical structure orthogonally to the back side proximate the top end and extending in a first direction over a surface;

a first crossbar having a first length, the first crossbar connected orthogonally at one end of the vertical structure proximate to the bottom end at the inner side of the first vertical member and connected at a second end of the vertical structure proximate to the bottom end and the inner side of the second vertical member; and a platform structure having a third and a fourth horizontal elongate member each including a length, each of the third and fourth horizontal elongate members attached orthogonally at the front side and the bottom end of a respective one of the first and second vertical members, extending away from the vertical structure in a second direction opposite the first direction of the first and second horizontal elongate members;

wherein the length of the first and second horizontal elongate members and the third and fourth horizontal elongate members are substantially equal in length, the first and second horizontal elongate members lying flat on the surface that extends from an upper edge of a walled space and extends from the vertical structure downward into the walled space, the back sides of the first and second tubular elongate vertical members are adjacent to a wall of the walled space, and the platform structure extends from a lower end of the vertical structure into and away from the wall of the walled space, providing a support surface for a user to stand upon to perform maintenance on the wall proximate the vertical structure, wherein a ring-shaped attachment interface is positioned at a distal end of each of the first and second horizontal elongate members such that the upper horizontal structure is configured to be anchored to the surface that extends from the upper edge of the walled space by placing one or more stakes proximate to or through each said attachment interface.

2. The scaffold apparatus of claim 1 wherein the upper horizontal structure, the vertical structure and the platform structure each comprise welded assemblies of lengths of hollow square metal tubing.

3. The scaffold apparatus of claim 1 wherein the upper horizontal structure comprises a first and a second separate hollow square metal tubing.

4. The scaffold apparatus of claim 1 wherein the platform structure comprises a rectangular welded assembly of hollow square metal tubing covered by an expanded metal sheet.

5. The scaffold apparatus of claim 1 wherein the one or more stakes are driven through the attachment interfaces of the upper horizontal structure.

6. The scaffold apparatus of claim 1 wherein the vertical structure comprises the first and second vertical members as hollow square or round metal tubing having a first square dimension, each having a plurality of horizontal through holes spaced apart along a height of the first and second vertical members, and additionally third and fourth vertical members as hollow square metal tubing having a second square dimension greater than the first square dimension, the first and second vertical members sliding into the third and fourth vertical members, with the platform structure welded to a lower extremity of the third and fourth vertical members, and further comprising a first and a second pin structure on each of the third and fourth vertical members adapted such that a first pin of the first pin structure is configured to pass through an individual one of the plurality of through holes spaced apart along the height of the first vertical member, and a second pin of the second pin structure is configured to pass through an individual one of the plurality of through holes spaced apart along the height of the second vertical member, fixing a vertical position of the platform structure relative to the upper horizontal structure, and wherein the first and second pins are configured to be withdrawn and reinserted into a different one of the plurality of through holes on the first and second vertical members, changing the vertical position of the platform structure relative to the upper horizontal structure.

7. The scaffold apparatus of claim 1 wherein the upper horizontal structure is a rectangular welded assembly of hollow square metal tubing having one longer lengthwise member and two shorter side members.

8. The scaffold apparatus of claim 7 wherein the two vertical members of the vertical structure attach to ends of the two shorter side members away from the one longer lengthwise member.

9. The scaffold apparatus of claim 1 wherein the upper horizontal structure is a rectangular welded assembly of hollow square metal tubing having two longer lengthwise members and two shorter side members.

10. The scaffold apparatus of claim 9 wherein the two vertical members of the vertical structure attach to ends of the two shorter side members.

11. The scaffold apparatus of claim 1 further comprising a ladder comprising a third vertical member in the vertical structure joined at vertical intervals by a plurality of horizontal members as ladder rungs between the third vertical member and either the first or the second vertical members.

12. The scaffold apparatus of claim 11 wherein the first, the second and the third vertical members lie in a plane of the vertical structure parallel the wall of the walled space, such that the ladder is in the plane of the vertical structure.

13. The scaffold apparatus of claim 11 wherein the third vertical member is attached to a side member of the platform structure, such that the ladder is in a plane at a right angle to the vertical structure.

* * * * *